United States Patent [19]

Tong

[11] Patent Number: 4,832,335

[45] Date of Patent: May 23, 1989

[54] EXERCISE AIR PUMP

[76] Inventor: Kun-Yuan Tong, 2308 W. Doublegate Dr., Albany, Ga. 31707

[21] Appl. No.: 99,157

[22] Filed: Sep. 21, 1987

[51] Int. Cl.[4] ..... A63B 21/00

[52] U.S. Cl. ..... 272/130

[58] Field of Search ..... 272/130; 417/118, 120, 417/130, 131, 134; 92/117 R, 117 A

[56] References Cited

U.S. PATENT DOCUMENTS 767,008 8/1904 Pelletier et al. ..... 272/130

2,825,563 3/1958 Lawton ..... 272/130

3,471,145 10/1969 Berger ..... 272/130

4,290,599 9/1981 Berger ..... 272/130

*Primary Examiner*—Richard J. Apley

*Assistant Examiner*—J. Welsh

[57] ABSTRACT

An exercise air pump is an exercise equipment of compression/expansion action capable of variable resistant force by means of generated air pressure/partial vacuum. The exercise air pump includes a tubular casing construction with a cap which allows for the entrance and retainment of a hollow plunger unit with an exchangeable rubber stopper which contains a central exhaust hole which is of variable sizes.

4 Claims, 1 Drawing Sheet

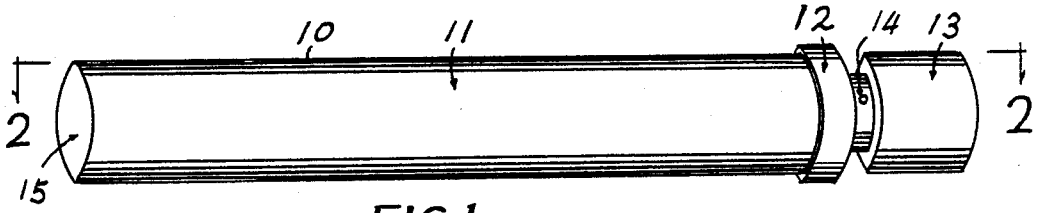
FIG 1
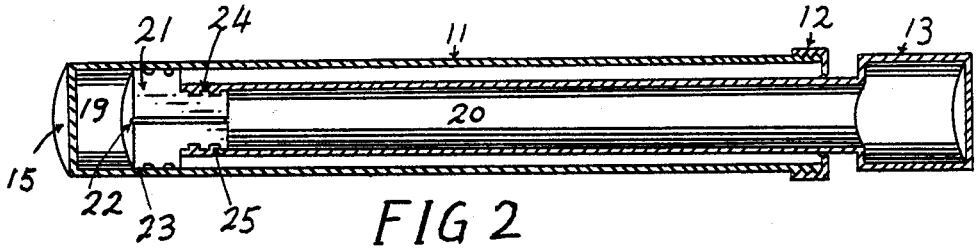
FIG 2
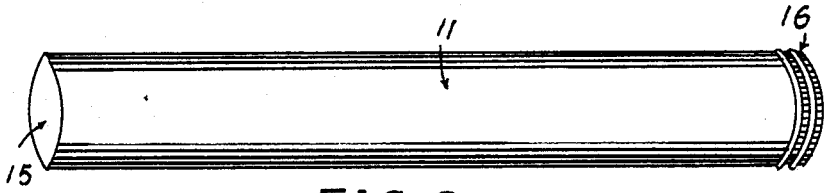
FIG 3
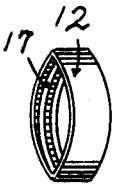
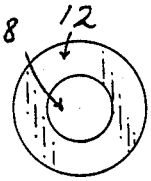
FIG 4. FIG 5
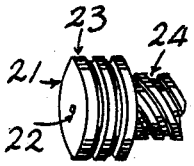
FIG 6
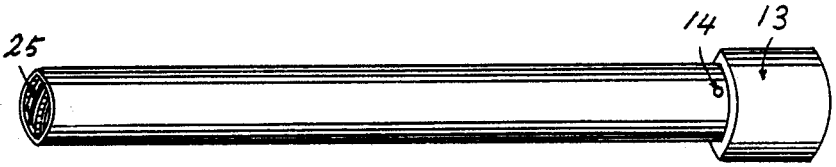
FIG 7

EXERCISE AIR PUMP

BACKGROUND OF THE INVENTION

The objective of the invention is to provide an exercise instrument capable of providing variable resistance suitable to the exerciser's need.

More specifically, an object of the invention is to provide an exercise instrument of compression/expansion action including tubular casing construction surrounding a hollow plunger unit with exchangeable rubber stoppers of variable central exhaust holes.

A futher object is to provide an exercise instrument whose resistance force increases proportionally in correspondence with the user's input force from almost zero pounds to several hundreds pounds. The variable resistant property of the exercise air pump makes it an ideal exercise instrument for both the beginning and advanced exercisers.

Other features and advantages of the invention will become apparent during the course of the following description.

BRIEF SUMMARY OF THE INVENTION

Exercise air pump uses air as a medium to produce passive resistance power in two directions. When the plunger enclosed in a casing tube is compressed telescopically inwards, the compressed air which is generated produces a passive outward expansion power. When the plunger is expanded telescopically outwards in a casing tube, a partial vacuum which is generated produces a passive inward suction power. The passive outward expansion power and passive inward suction power are directly proportional in correspondence with inward compressing force and outward expanding force.

BRIEF DESCRIPTION OF THE DRAWINGS

FIG. 1 is a perspective view of an exercise air pump according to the present invention.

FIG. 2 is a vertical view taken on line 2—2 of FIG. 1.

FIG. 3 is a perspective view of the exercise air pump tubular casing construction.

FIG. 4 is a perspective view of the cap of the tubular casing construction.

FIG. 5 is a plan view of the cap of tubular casing construction.

FIG. 6 is a perspective view of the rubber stopper of the hollow plunger unit.

FIG. 7 is a perspective view of the hollow plunger unit.

DETAILED DESCRIPTION

Referring to the drawings in detail wherein like numerals designate like parts, an exercise air pump 10 according to the present invention includes a tubular casing construction 11 with cap 12 enclosing one end of a hollow plunger unit 13 with rubber stopper 21.

The vertical section view of the exercise air pump 10 as shown in FIG. 2, well demonstrates the basic arrangement of the invention's components-tubular casing construction 11, hollow plunger unit 13.

The tubular casing construction 11, as shown in FIG. 3, is fitted over on the open end by a cap 12, as shown in FIG. 4, which has a threaded interior 17 to be screw onto the threadee top 16 of the tubular casing construction 11. The cap 12 has a central hole 18, as shown in FIG. 5, to admit the hollow plunger unit 13 into and retain the rubber stopper 21 within the tubular casing construction 11, as shown in FIG. 2. The tubular casing construction 11 has a closed end 15 and an open threaded end 16.

The hollow plunger unit 13, as shwon in FIG. 7, is closed on one end by a rubber stopper, as shown in FIG. 6. The rubber stopper 21, as shown in FIG. 6, has a central inlet/outlet hole 22 which traverses the entire length of the rubber stopper 21 allowing for pressurized air to pass through, ridged edges 23 for hermetic seal with interior wall of the tubular casing construction 11, and threaded end 24 to be screwed into the threaded end 25 of the hollow plunger 13, as shown in FIG. 7. The central hole 22 of rubber stopper 21 can be of a variety of sizes (e.g. 1 mm, 2 mm, or 3 mm in diameter) to vary the rate of air inlet/outlet, thus varying the resistance force to suit the beginning or advanced exerciser. The hollow plunger unit 13, as shown in FIG. 7, has an exhaust hole 14 at the exposed end.

The exerciser, by grasping either ends of the exercise air pump (i.e. the exposed ends of the tubular casing construction 11 and hollow plunger unit 13), expands/-compresses the exercise air pump with a pulling/pushing action. The expansion of the exercise air pump 10 produces a partial vacuum in the tubular casing construction chamber 19, thus generating a resistant force to the outward pull by the exerciser. The partial vacuum is slowly alleviated by the inlet of air through the exhaust hole 14 of plunger 13, the chamber 20 of plunger 13 and the central exhaust hole 22 of rubber stopper. The compression of the exercise air pump 10 produces an area of pressurized air in the tubular casing construction chamber 19, thus generating a resistant force to the inward push of the exerciser. The area of pressurized air is slowly alleviated by the outlet of air through the central exhaust hole 22 of rubber stopper 21, the chamber 20 of plunger 13 and the exhaust hole 14 of plunger 13. The force of the resistant pressure is in direct propertion to the force applied to the exercise air pump 10 in that the greater the push/pull force applied by the exerciser, the greater the resistant force generated. The variable resistant property of the exercise equipment enables it to suit the needs of the beginning and the most advanced exerciser.

I claim:

1. An exercise air pump comprising a single open ended tubular casing means with a detachable cap over the open end allowing for the entrance of a hollow plunger unit into said tubular casing means, a hollow plunger unit retained in said tubular casing means, said hollow plunger unit having an open end within said tubular casing means, an exposed end outside of said tubular casing means, a removable rubber stopper disposed in said open end for hermetically sealing with the interior wall of said tubular casing means and having a central air inlet/outlet hole for allowing air into and out of the hollow plunger unit, and an air inlet/outlet hole located in said hollow plunger unit near said exposed end which functions in cooperation with said central air inlet/outlet.

2. The device of claim 1, wherein said rubber stopper is replaceable with another rubber stopper having a central air inlet/outlet hole with a different diameter in order to vary the resistance.

3. The device of claim 1, wherein said rubber stopper has a threaded end for connection to said plunger unit.

4. The device of claim 1, wherein said rubber stopper has a ridged edge for hermetic seal with said tubular casing means.

* * * * *